United States Patent [19]

Howard, Jr. et al.

[11] Patent Number: 5,019,978

[45] Date of Patent: May 28, 1991

[54] DEPTH DETERMINATION SYSTEM UTILIZING PARAMETER ESTIMATION FOR A DOWNHOLE WELL LOGGING APPARATUS

[75] Inventors: Allen Q. Howard, Jr., Kingswood, Tex.; David J. Rossi, Newtown, Conn.

[73] Assignee: Schlumberger Technology Corporation, Houston, Tex.

[21] Appl. No.: 240,025

[22] Filed: Sep. 1, 1988

[51] Int. Cl.[5] ..... E21B 47/04; G01B 7/26; G01B 7/04

[52] U.S. Cl. ..... 364/422; 73/151.5

[58] Field of Search ..... 364/422; 324/206; 367/56, 59; 33/735; 73/151.5

[56] References Cited

U.S. PATENT DOCUMENTS

| | | | |
|---|---|---|---|
| 3,465,447 | 9/1969 | Bowers et al. | 33/735 |
| 3,465,448 | 9/1969 | Whitefill, Jr. | 33/735 |
| 3,490,149 | 1/1970 | Bowers | 33/735 |
| 3,490,150 | 1/1970 | Whitefill, Jr. | 33/735 |
| 3,497,958 | 3/1970 | Gollwitzer | 33/735 |
| 4,117,600 | 10/1978 | Guignard et al. | 33/735 |
| 4,320,458 | 3/1982 | Vincent | 364/422 |
| 4,334,271 | 6/1982 | Clavier | 364/422 |
| 4,545,242 | 10/1985 | Chan | 73/152 |
| 4,718,168 | 1/1988 | Kerr | 364/562 |
| 4,797,822 | 1/1989 | Peters | 364/422 |
| 4,852,263 | 8/1989 | Kerr | 364/562 |

FOREIGN PATENT DOCUMENTS 2156516 10/1985 United Kingdom .

OTHER PUBLICATIONS

Chan, David, S. K., "Accurate Depth Determination in Well Logging", IEEE Transactions on Acoustics, Speech, and Signal Processing, vol. ASSP-32, No. 1, Feb. 1984, pp. 42–48.

Marple, S. Lawrence Jr., Digital Spectral Analysis With Applications, Ch. 9, Autoregressive Spectral Estimation: Sequential Data Algorithms, 1987, pp. 261–277.

*Primary Examiner*—Clark A. Jablon

*Attorney, Agent, or Firm*—Henry N. Garrana; John H. Bouchard

[57] ABSTRACT

Due to irregularities associated with the borehole of an oil well, a depth determination system for a well logging tool, suspended from a cable in the borehole of the oil well, produces a correction factor, which factor is added to or subtracted from a surface depth reading on a depth wheel, thereby yielding an improved indication of the depth of the tool in the borehole. The depth determination system includes an accelerometer on the tool, a depth wheel on the surface for producing a surface-correct depth reading, a computer for a well logging truck and a depth determination software stored in the memory of the computer. The software includes a novel parameter estimation routine for estimating the resonant frequency and the damping constant associated with the cable at different depths of the tool in the borehole. The resonant frequency and damping constant are input to a kalman filter, which produces the correction factor that is added to or subtracted from the depth reading on the depth wheel thereby producing a coherent depth of the well logging tool in the borehole of the oil well. Coherent depth is accurate over the processing window of downhole sensors, but not necessarily over the entire depth of the well. Thus over the processing window (which may be up to 10 m) as required by the tool software to estimate formation features, the distance between any two points in the processing window is accurately determined. No claim of depth accuracy relative to the surface of the earth is made.

12 Claims, 5 Drawing Sheets

DEPTH DETERMINATION SYSTEM UTILIZING PARAMETER ESTIMATION FOR A DOWNHOLE WELL LOGGING APPARATUS

BACKGROUND OF THE INVENTION

The subject matter of the present invention relates to well logging apparatus, and, in particular, to an accurate depth determination system, using parameter estimation, for use with the well logging apparatus.

In a typical well logging scenario, a string of measurement tools is lowered on cable to the bottom of an oil well between perhaps 2 to 5 km in the earth. Geophysical data is recorded from the tool instruments as the cable is wound in at constant speed on a precision winch. The logging speed and cable depth are determined uphole with a depth wheel measurement instrument and magnetic markers on the cable. The problem, however, is that, when disposed downhole, the tool string is usually not in uniform motion, particularly for deviated holes occurring in offshore wells. The suite of measurements from the tool string are referred to a common depth using depth wheel data. However, if the tool motion is non-uniform, this depth shifting is only accurate in an average sense. The actual downhole tool position as a function of time is required to accurately depth shift the suite of sensor data to a common point. When the motion is not uniform, the depth shift applied to the various sensors on the tool string is time-dependent. Therefore, given surface depth wheel data, and downhole axial accelerometer data, an unbiased estimate of the true axial position of the logging tool string is required to fully utilize the higher resolving power (mm to cm range) of modern logging tools.

The depth estimate must be coherent over the processing window of downhole sensors, but not necessarily over the entire depth of the well. Thus over the processing window (which may be up to 10 m) as required by the tool software to estimate formation features, the distance between any two points in the processing window must be accurately determined. No claim of depth accuracy relative to the surface of the earth is made. One depth determination technique is discussed by Chan, in an article entitled "Accurate Depth Determination in Well Logging"; IEEE-Transactions-on Acoustics, Speech, and Signal Processing; 32, p 42–48, 1984, the disclosure of which is incorporated by reference into this specification. Another depth determination technique is discussed by Chan in U.S. Pat. No. 4,545,242 issued Oct. 8, 1985, the disclosure of which is incorporated by reference into this specification. In Chan, no consideration is given to certain types of non-uniform motion, such as damped resonant motion known as "yo-yo", arising from oscillations of the tool on the downhole cable. Accordingly, a more accurate depth determination system, for use with downhole well logging tools, is required.

SUMMARY OF THE INVENTION

Accordingly, it is an object of the present invention to improve upon a prior art depth determination technique by estimating at least two parameters and building a state vector model of tool motion which takes at least these two additional parameters into consideration when determining the actual, true depth of a well logging apparatus in a borehole of an oil well.

It is a further object of the present invention to improve upon prior art depth determination techniques by estimating a dominant mechanical resonant frequency parameter and a damping constant parameter and building a state vector model of tool motion which takes the resonant frequency parameter and the damping constant parameter into consideration when determining the actual, true depth of a well logging apparatus in a borehole of an oil well.

It is a further object of the present invention to provide a new depth determination software, for use with a well-site computer, which improves upon prior art depth determination techniques by estimating a dominant mechanical resonant frequency parameter and a damping constant parameter and taking these two parameters into consideration when correcting an approximate indication of depth of a well logging apparatus to determine the actual, true depth of the well logging apparatus in a borehole.

These and other objects of the present invention are accomplished by observing that the power spectral density function of a typical downhole axial accelerometer data set has a few prominent peaks corresponding to damped longitudinal resonant frequencies of the tool string. The data always shows one dominant mode defined by the largest amplitude in the power spectrum. The associated frequency and damping constant are slowly varying functions of time over periods of minutes. Therefore, when building a state vector model of tool motion, for the purpose of producing an accurate estimate of depth of the downhole tool, particular emphasis must be given to a special type of non-uniform motion known as "yo-yo", arising from damped longitudinal resonant oscillations of the tool on the cable, in addition to hole deviations from the vertical, and other types of non-uniform motion, such as one corresponding to time intervals when the tool is trapped and does not move. In accordance with these and other objects of the present invention, a dominant mechanical resonant frequency and damping constant are built into the state vector model of tool motion. Physically, the state vector model of tool motion is a software program residing in a well logging truck computer adjacent a borehole of an oil well. However, in order to build the resonant frequency and damping constant into the state vector model, knowledge of the resonant frequency and damping constant is required. The resonant frequency and the damping constant are both a function of other variables: the cable density, cable length, tool weight, and borehole geometry. In general, these other variables are not known with sufficient accuracy. However, as will be shown, the resonance parameters can be estimated in real time using an autoregressive model of the acceleration data. A Kalman filter is the key to the subject depth estimation problem. Chan, in U.S. Pat. No. 4,545,242, uses a kalman filter. However, contrary to the Chan Kalman filter, the new Kalman filter of the subject invention contains a new dynamical model with a damped resonant response, not present in the Chan Kalman filter. Therefore, the new model of this specification includes a real time estimation procedure for a complex resonant frequency and damping constant associated with vibration of the tool string, when the tool string "sticks" in the borehole or when the winch "lurches" the tool string. The resonance parameters and damping constant are determined from the accelerometer data by a least-mean-square-recursive fit to an all pole model. Time intervals when the tool string is stuck are detected using logic which requires both that the acceleration data remains statistically constant and that the tool speed estimate produced by the filter be statistically zero. The component of acceleration arising from gravity is removed by passing the accelerometer data through a low pass recursive filter which removes frequency components of less than 0.2 Hz. Results of numerical simulations of the filter indicate that relative depth accuracy on the order of 3 cm is achievable.

Further scope of applicability of the present invention will become apparent from the detailed description presented hereinafter. It should be understood, however, that the detailed description and the specific examples, while representing a preferred embodiment of the invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinafter, and the accompanying drawings, which are given by way of illustration only and are not intended to be limitative of the present invention, and wherein.

DESCRIPTION OF THE PREFERRED EMBODIMENT

Figure 1:
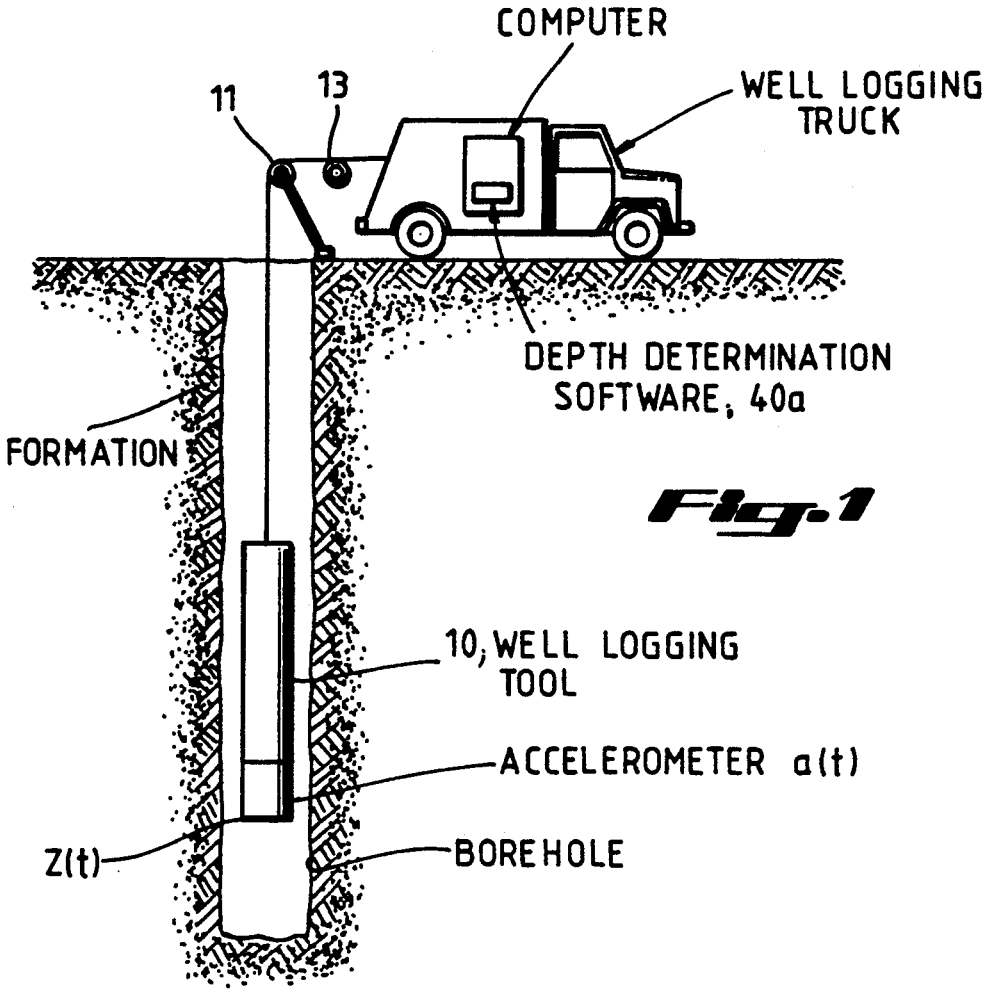
FIG. 1 illustrates a borehole in which an array induction tool (AIT) is disposed, the AIT tool being connected to a well site computer in a logging truck wherein a depth determination software of the present invention is stored.

Referring to FIG. 1, a borehole of an oil well is illustrated. A well logging tool 10 (such as the array induction tool disclosed in prior pending application Ser. No. 043,130 filed Apr. 27, 1987, entitled "Induction Logging Method and Apparatus") is disposed in the borehole, the tool 10 being connected to a well logging truck at the surface of the well via a logging cable, a sensor 11 and a winch 13. The well logging tool 10 contains an accelerometer for sensing the axial acceleration $a_z(t)$ of the tool, as it is lowered into or drawn up from the borehole. The sensor 11 contains a depth wheel for sensing the depth of the tool 10 at any particular location or position within the well. The depth wheel of sensor 11 provides only an estimate of the depth information, since it actually senses only the amount of cable provided by the winch 13 as the tool 10 is pulled up the borehole. The depth wheel provides only the estimate of depth information, since the tool 10 may become stuck in the borehole, or may experience a "yo-yo" effect. During the occurrence of either of these events, the depth indicated by the depth wheel would not reflect the actual, true instantaneous depth of the tool.

The well logging truck contains a computer in which the depth determination software of the present invention is stored. The well logging truck computer may comprise any typical computer, such as the computer set forth in U.S. Pat. No. 4,713,751 entitled "Masking Commands for a Second Processor When a First Processor Requires a Flushing Operation in a Multiprocessor System", the disclosure of which is incorporated by reference into the specification of this application.

Figure 2:
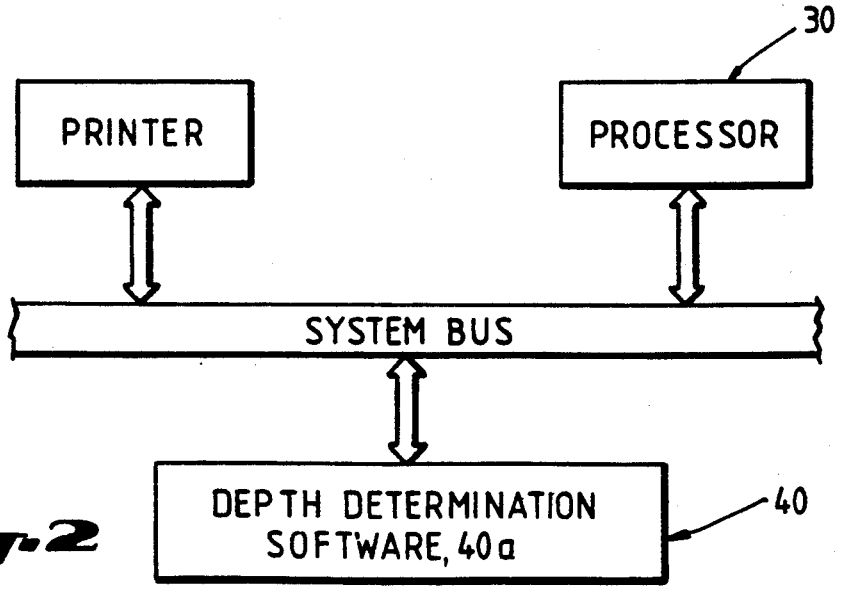
FIG. 2 illustrates a more detailed construction of the well site computer having a memory wherein the depth determination software of the present invention is stored.

Referring to FIG. 2, a simple construction of the well logging truck computer is illustrated. In FIG. 2, the computer comprises a processor 30, a printer, and a main memory 40. The main memory 40 stores a set of software therein, termed the "depth determination software **40*a*" of the present invention. The computer of FIG. 2** may be any typical computer, such as the multiprocessor computer described in U.S. Pat. No. 4,713,751, referenced hereinabove, the disclosure of which is incorporated by reference into the specification of this application.

Figure 3:
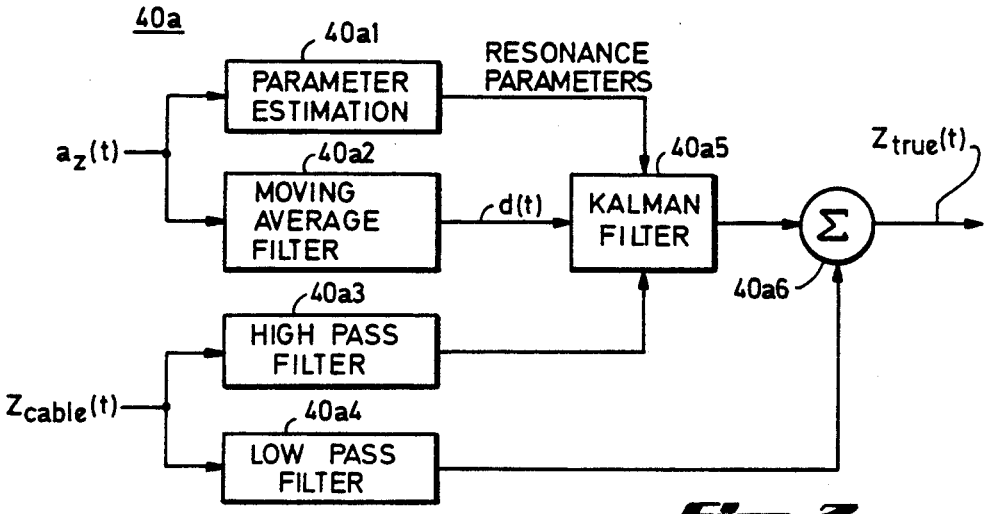
FIG. 3 illustrates a more detailed construction of the depth determination software of the present invention.

Referring to FIG. 3, a flow diagram of the depth determination software **40*a* of the present invention, stored in memory 40 of FIG. 2**, is illustrated.

In FIG. 3, the depth determination software **40*a* comprises a parameter estimation routine 40*a*1 and a moving average filter 40*a*2, both of which receive an input $a_z(t)$ from an accelerometer on tool 10, a high pass filter 40*a*3 and a low pass filter 40*a*, both of which receive an input ($z_c(t)$) from a depth wheel on sensor 11. A typical depth wheel, for generating the $z_c(t)$ signal referenced above may be found in U.S. Pat. No. 4,117,600 to Guignard et al, assigned to the same assignee as that of the present invention. The outputs from the parameter estimation routine 40*a*1, the moving average filter 40*a*2, the high pass filter 40*a*3 and the low pass filter 40*a* are received by a kalman filter 40*a*5. The Kalman filter 40*a*5 generally is of a type as generally described in a book publication entitled "Applied Optimal Estimation", edited by A. Gelb and published by M.I.T. Press, Cambridge, Mass. 1974, the disclosure and content of which is incorporated by reference into this specification. The outputs from the kalman filter 40*a*5 and the low pass filter 40*a* are summed in summer 40*a*6, the output from the summer 40*a*6 representing the true depth of the well logging tool, the tool 10**, in the borehole of the oil well.

A description of each element or routine of FIG. 3 will be provided in the following paragraphs.

The tool 10 of FIG. 1 contains an axial accelerometer, which measures the axial acceleration $a_z(t)$ of the tool 10 as it traverses the borehole of the oil well. The sensor 11 contains a depth wheel which measures the apparent depth ($z_c(t)$) of the tool 10, as the tool is drawn up the borehole. As mentioned above, a typical depth wheel is found in U.S. Pat. No. 4,117,600, the disclosure of which is incorporated by reference into the specification of this application. The parameter estimation routine **40*a*1 and the moving average filter 40*a*2** both receive the accelerometer input $a_z(t)$.

The parameter estimation routine **40*a*1** estimates the resonant frequency $\omega_0$ and the damping constant $\zeta_0$ associated with a system comprising a mass (the AIT tool) suspended from a spring (the AIT cable). In such a system, an equation of motion is as follows:

$$\frac{d^2z(t)}{dt^2} + \omega_0^2 z(t) = 0,$$

where $$z(t) = A\cos(\omega_0 t + \theta_0)$$

Figure 4:
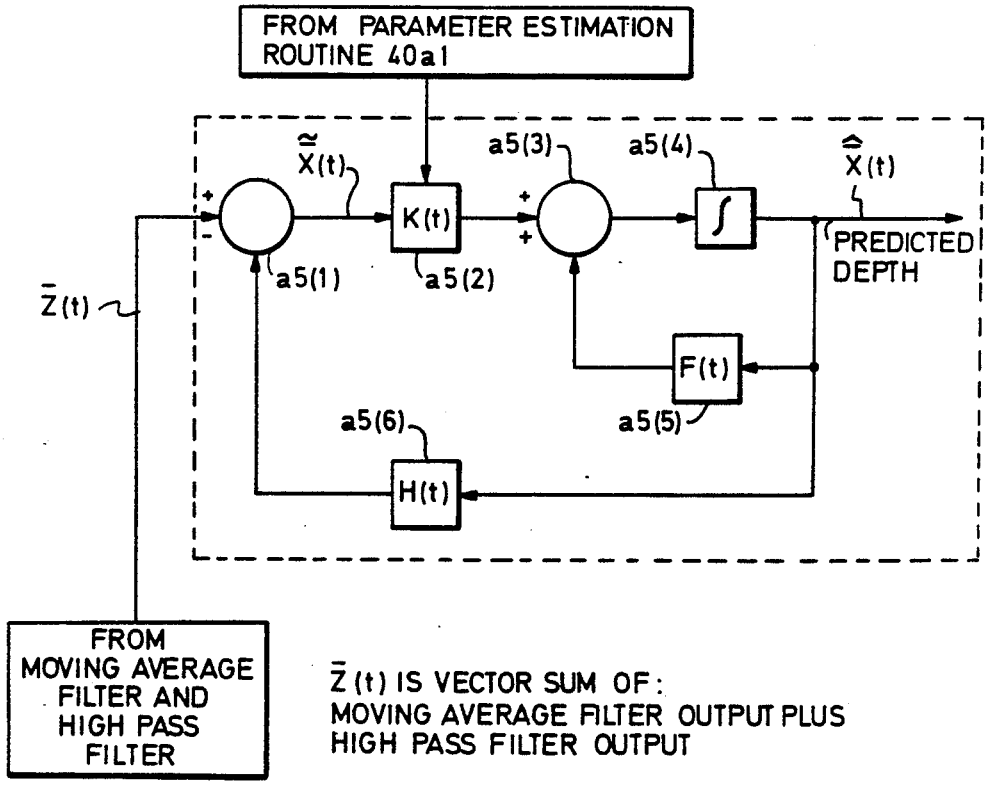
FIG. 4 illustrates the kalman filter used by the depth determination software of FIG. 3.

The term $\omega_0$ is the resonant frequency estimated by the parameter estimation routine 40a1 of FIG. 4.

However, in the above referenced system, as the mass suspends from the spring, the motion of the mass gradually decreases in terms of its amplitude, which indicates the presence of a damping constant. Thus, the motion of the mass gradually decreases in accordance with the following relation:

$e^{-\zeta_0\omega_0 t}$ where $\zeta_0$ is the damping constant estimated by the parameter estimation routine 40a1.

Therefore, the parameter estimation routine 40a1 provides an estimate of the resonant frequency $\omega_0$ and the damping constant $\zeta_0$ to the kalman filter 40a5. More detailed information regarding the parameter estimation routine 40a1 will be set forth below in the Detailed Description of the Preferred Embodiment.

The moving average filter 40a2 removes the average value of the acceleration signal input to the filter 40a2, and generates a signal indicative of the following expression:

$$a_z(t) - g\cos(\theta)$$

Therefore, the moving average filter 40a2 provides the expression $a_z(t) - g\cos(\theta)$ to the kalman filter 40a5.

This expression may be derived by recognizing that the tool 10 of FIG. 1 may be disposed in a borehole which is not perfectly perpendicular with respect to a horizontal; that is, the borehole axis may be slanted by an angle $\theta$ (theta) with respect to a vertical line. Therefore, the acceleration along the borehole axis $a_z(t)$ is a function of gravity (g), whose vector line is parallel to the vertical line, and of a dynamic variable d(t). The dynamic variable d(t) is an incremental component of acceleration resulting from unexpected lurch in the tool along the borehole axis (hereinafter called "incremental acceleration signal"). This lurch in the tool cable would result, for example, when the tool is "stuck" in the borehole due to irregularities in the borehole wall. Resolving the gravity vector (g) into its two components, one component being parallel to the borehole axis ($g_z$) and one component being perpendicular to the borehole axis ($g_y$), the parallel component $g_z$ may be expressed as follows:

$$g_z = g\cos\theta$$

Therefore, the acceleration along the borehole axis $a_z(t)$ is the sum of the parallel component $g_z$ and the dynamic variable d(t), as seen by the following incremental acceleration expression:

$$a_z(t) = g\cos(\theta) + d(t).$$

The moving average filter 40a2 generates a signal indicative of the dynamic variable d(t). The dynamic variable d(t), from the above equation, is equal to $a_z(t) - g\cos(\theta)$. Therefore, the moving average filter 40a2 provides the following incremental acceleration signal to the kalman filter 40a5:

$$d(t) = a_z(t) - g\cos(\theta).$$

The accelerometer on the tool 10 provides the $a_z(t)$ input to the above d(t) equation. More detailed information regarding the moving average filter 40a2 will be provided in the detailed description of the preferred embodiment set forth hereinbelow.

The output signal $z_c(t)$ from the depth wheel inherently includes a constant speed component $z_1(t)$ of distance traveled by the tool string 10 in the borehole plus an incremental or non-uniform distance $z_2(t)$ which results from an instantaneous "lurch" of the tool cable. Therefore, the high pass filter 40a3, which receives the input $z_c(t)$ from the depth wheel, removes the constant speed component $z_1(t)$ of the $z_c(t)$ signal. It will NOT provide a signal to the kalman filter 40a5 when the tool 10 is drawn up from the borehole at a constant velocity (acceleration is zero when the tool is being drawn up from the borehole at constant velocity). Therefore, the high pass filter 40a3 will provide a signal to the kalman filter 40a5 representative of an incremental distance $z_2(t)$ (hereinafter termed "incremental distance signal"), but only when the winch, which is raising or lowering the tool 10 into the borehole, instantaneously "lurches" the tool 10. Recall that the moving average filter also generates an incremental acceleration signal d(t) when the tool "lurches" due to irregularities in the borehole wall, or winch-related lurches.

The low pass filter 40a (otherwise termed the "depth wheel filter"), which receives the input $z_c(t)$ from the depth wheel, removes the incremental distance $z_2(t)$ component of $z_c(t)$ and provides a signal to the summer 40a6 indicative of the constant speed component $z_1(t)$ of the actual depth reading $z_c(t)$ on the depth wheel. Therefore, since the high and low pass filters are complimentary, $z_1(t) + z_2(t) = z_c(t)$. More detailed information relating to the depth wheel filter 40a will be set forth below in the Detailed Description of the Preferred Embodiment.

The Kalman filter 40a5 receives the resonant frequency and damping constant from the parameter estimation routine 40a1, the dynamic variable or incremental acceleration signal d(t) from the moving average filter, and the incremental distance signal from the high pass filter, and, in response thereto, generates or provides to the summer 40a6 a correction factor, which correction factor is either added to or subtracted from the constant speed component $z_1(t)$ of the depth wheel output $z_c(t)$, as supplied by the low pass filter 40a. The result is a corrected, accurate depth figure associated with the depth of the tool 10 in the borehole of FIG. 1.

Referring to FIG. 4, a detailed construction of the Kalman filter 40a5 of FIG. 3 is illustrated. In FIG. 4, the kalman filter 40a5 comprises a summer a5(1), responsive to a vector input z(t), a kalman gain K(t) a5(2), a further summer a5(3), an integrator a5(4), an exponential matrix function F(t) a5(5), defined in equation 14 of the Detailed Description set forth hereinbelow, and a measurement matrix function H(t) a5(6), defined in equation 48 of the Detailed Description set forth hereinbelow. The input z(t) is a two component vector. The first component is derived from the depth wheel measurement and is the output of the high pass filter 40a3. The second component of z(t) is an acceleration derived from the output of the moving average filter 40a2 whose function is to remove the gravity term g cos ($\theta$).

Figure 5:
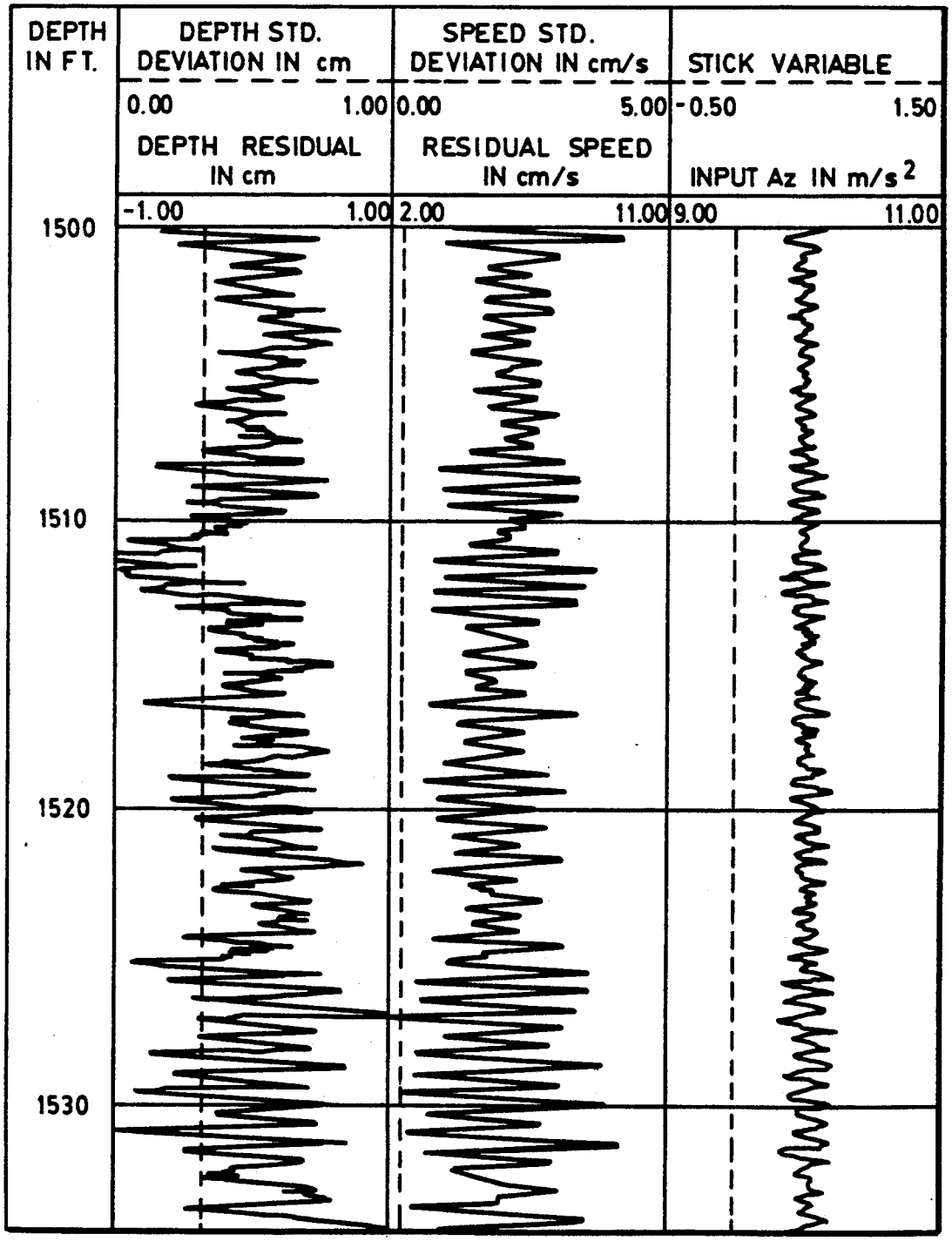
FIG. 5 illustrates a depth processing output log showing the residual depth (the correction factor) added to the depth wheel output to yield the actual, true depth of the induction tool in the borehole.

Referring to FIG. 5, a depth processing output log is illustrated, the log including a column entitled "depth residual" which is the correction factor added to the depth wheel output from low pass filter 40a by summer 40a6 thereby producing the actual, true depth of the tool 10 in the borehole. In FIG. 5, the residual depth (or correction factor) may be read from a graph, which residual depth is added to (or subtracted from) the depth read from the column entitled "depth in ft", to yield the actual, true depth of the tool 10.

Figure 6:
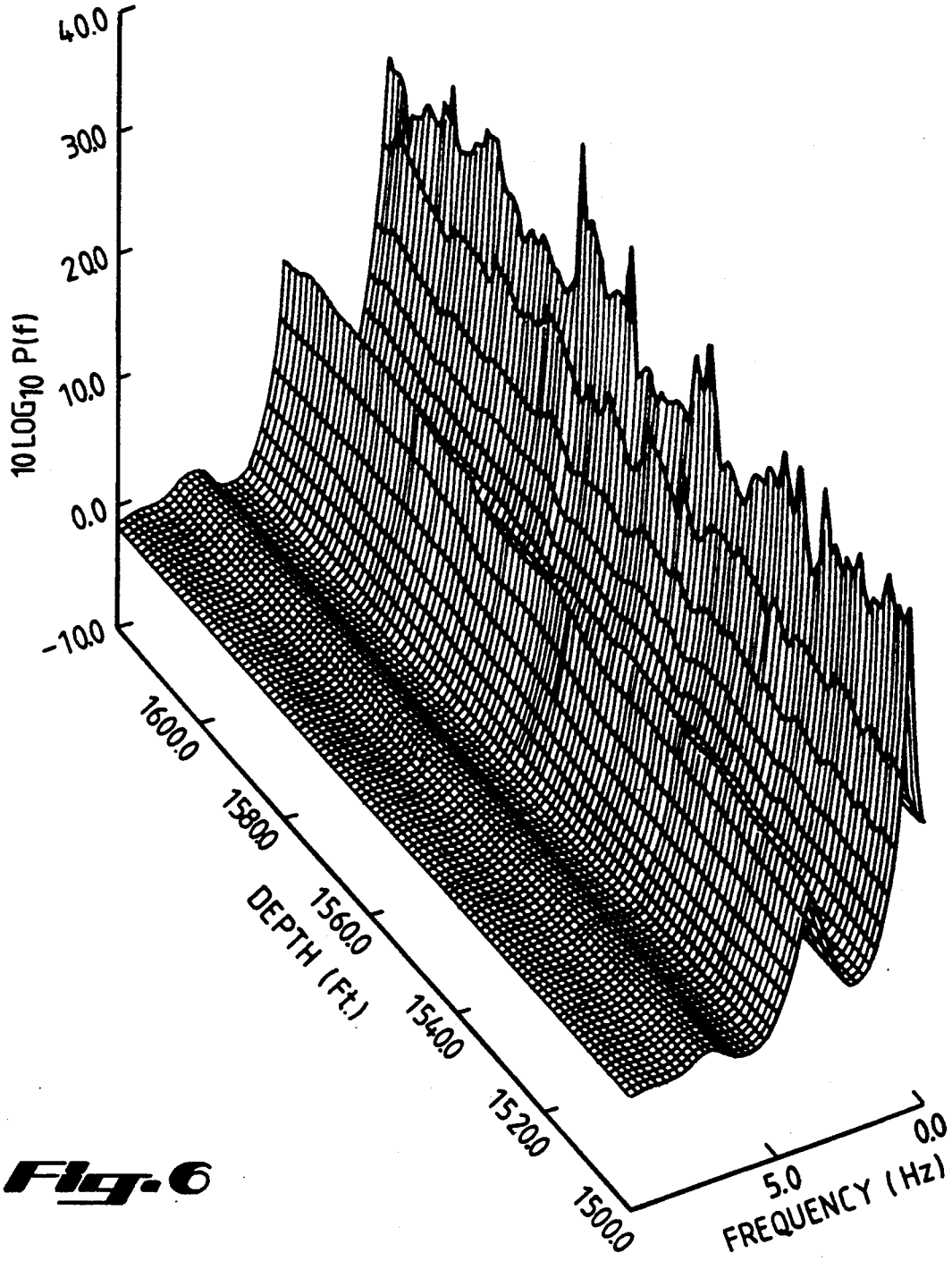
FIG. 6 illustrates the instantaneous power density, showing amplitude as a function of depth and frequency.

Referring to FIG. 6, an instantaneous power density function, representing a plot of frequency vs amplitude, at different depths in the borehole, is illustrated. In FIG. 6, referring to the frequency vs amplitude plot, when the amplitude peaks, a resonant frequency $\omega_0$, at a particular depth in the borehole, may be read from the graph. For a particular depth in the borehole, when the tool 10 is drawn up from the borehole, it may get caught on a borehole irregularity, or the borehole may be slanted on an incline. When this happens, the cable which holds the tool 10 in the borehole may vibrate at certain frequencies. For a particular depth, the dominant such frequency is called the resonant frequency $\omega_0$. The dominant resonant frequency, for the particular depth, may be read from the power density function shown in FIG. 6.

Figure 7:
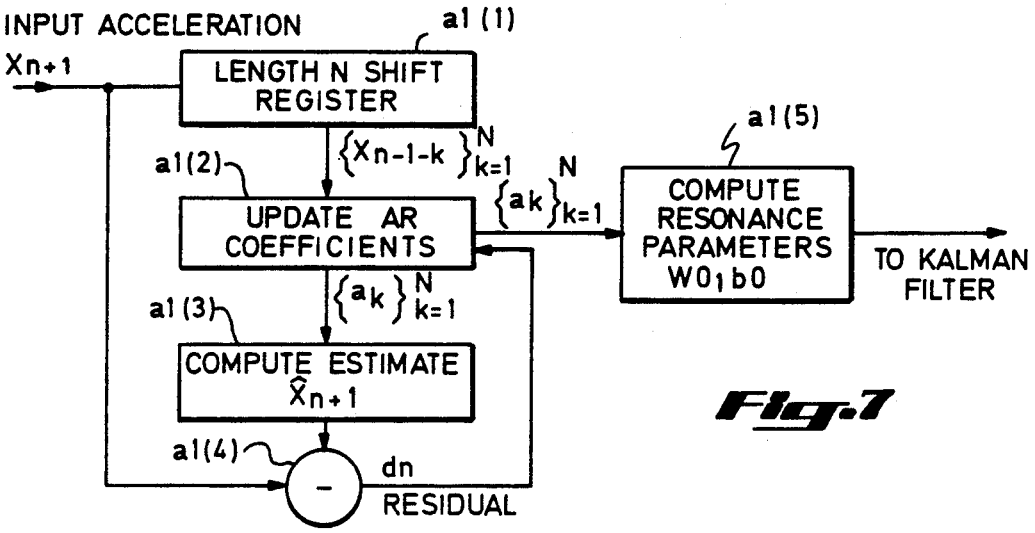
FIG. 7 illustrates a flow chart of the parameter estimation routine **40*a*1 of FIG. 3.

Referring to FIG. 7, a flow chart of the parameter estimation routine 40a1 is illustrated. In FIG. 7, input acceleration $a_z(t)$ is input to the parameter estimation routine 40a1 of the depth determination software stored in the well logging truck computer. This input acceleration $a_z(t)$ is illustrated in FIG. 7 as $x_{n+1}$ which is the digital sample of $a_z(t)$ at time $t=t_{n+1}$. The parameter estimation routine 40a1 includes a length N shift register a1(1), a routine called "update Ar coefficients" a1(2) which produces updated coefficients $a_k$, a routine called "compute estimate $x_{n+1}$" a1(3), a summer a1(4), and a routine called "compute resonance parameters" $\omega_0$, $\zeta_0$ a1(5), where $\omega_0$ is the resonant frequency and $\zeta_0$ is the damping constant. In operation, the instantaneous acceleration $x_{n+1}$ is input to the shift register a1(1), temporarily stored therein, and input to the "update AR coefficients" routine a1(2). This routine updates the coefficients $a_k$ in the following polynomial:

$$x_{n+1} = -\sum_{k=1}^{\hat{N}} a_k x_{n+1-k}.$$

The coefficients $a_k$ are updated recursively at each time step. The resonance parameters $\omega_0$ and $\zeta_0$ for the kalman filter 40a5 are obtained from the complex roots of the above referenced polynomial, using the updated coefficients $a_k$. A more detailed analysis of the parameter estimation routine 40a1 is set forth below in the Detailed Description of the Preferred Embodiment.

Figure 8:
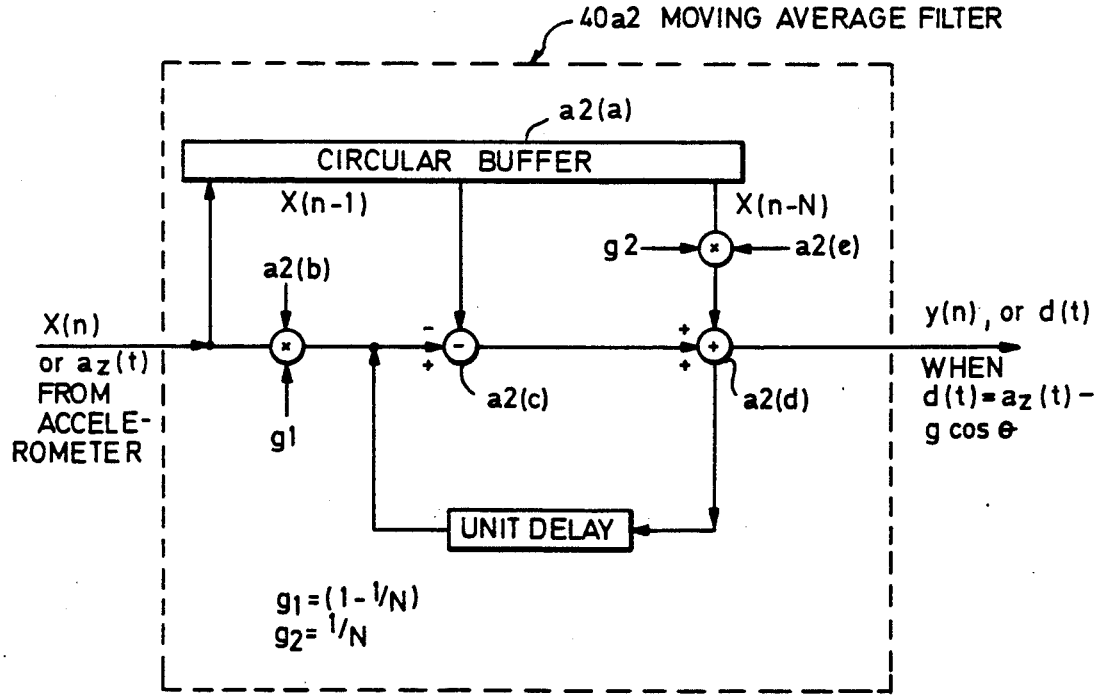
FIG. 8 illustrates a construction of the moving average filter shown in FIG. 3** of the drawings.

Referring to FIG. 8, a flow chart of the moving average filter 40a2 shown in FIG. 2 is illustrated.

In FIG. 8, the moving average filter 40a2 comprises a circular buffer a2(a) which receives an input from the accelerometer $a_z(t)$ or x(n), since $a_z(t)=x(n)$. The output signal y(n) from the summer a2(d) of the filter 40a2 is the same signal as noted hereinabove as the dynamic variable d(t). The filter 40a2 further comprises summers a2(b), a2(c), a2(d), and a2(e). Summer a2(b) receives the input x(n) (which is $a_z(t_n)$) and the input $g_1$, where $g_1=(1-1/N)$. Summer a2(c) receives, as an input, the output of summer a2(b) and, as an input, the output x(n−1) of circular buffer a2(a). Summer a2(d) receives, as an input, the output of summer a2(e) and, as an input, the output of summer a2(e). The output of summer a2(d) is fed back to the input of summer a2(b), and also represents the dynamic variable d(t), or y(n), mentioned hereinabove. Recall $d(t)=a_z(t)-g\cos(\theta)$. Summer a2(e) receives, as an input, output signal x(n−N) from the circular buffer a2(a) and, as an input, g2 which equals 1/N.

The moving average filter will be described in more detail in the following detailed description of the preferred Embodiment.

DETAILED DESCRIPTION OF THE PREFERRED EMBODIMENT

In the following detailed description, reference is made to the following prior art publications, the disclosures of which are incorporated by reference into the specification of this application.

4. Gelb, A., Editor, Applied Optimal Estimation, The M.I.T. Press, Cambridge, Mass., eighth printing, 1984.

5. Maybeck, P. S., Stochastic Models, Estimation and Control, vol, Academic Press, Inc., Orlando, Fla., 1979.

In the following paragraphs, a detailed derivation will be set forth, describing the parameter estimation routine 40a1, the kalman filter 40a5, the moving average filter 40a2 the high pass filter 40a3, and the low pass or depth wheel filter 40a4.

I. Dynamical Model of Tool Motion

Considering a system comprising a tool string consisting of a mass m, such as an array induction tool (AIT), hanging from a cable having spring constant k and viscous drag coefficient r, the physics associated with this system will be described in the following paragraphs in the time domain. This allows modeling of non-stationary processes as encountered in borehole tool movement. Let x(t) be the position of the point mass m as a function of time t. Then, the mass, when acted upon by an external time dependent force f(t), satisfies the following equation of motion:

$$m\ddot{x}(t)+r\dot{x}(t)+kx(t)=f(t). \tag{1}$$

In equation (1) the over dots correspond to time differentiation. To solve equation (1), it is convenient to make the change of variables $$\omega_0^2 = k/m, \qquad \zeta_0 = \frac{r}{2k}, \tag{2}$$

where $\omega_0$ is the resonant frequency in radians/s and $\zeta_0$ is the unitless damping constant. Define the point source response function h(t) as the causal solution to the equation $$\frac{\ddot{h}(t)}{\omega_0^2} + \frac{2\zeta_0 h(t)}{\omega_0} + h(t) = \delta(t), \tag{3}$$

where $\delta(t)$ is the Dirac delta function. With these definitions, equation (1) has the convolutional solution $$x(t) = \frac{1}{k}\int_0^t f(\tau)h(t-\tau)d\tau. \tag{4}$$

In equation (4), it is assumed that both f(t) and h(t) are causal time functions. The explicit form of the impulse response h(t) is $$h(t) = \frac{\omega_0 u(t)}{\sqrt{1-\zeta_0^2}} e^{-\zeta_0\omega_0 t} \sin(\omega_0 \sqrt{1-\zeta_0^2}\, t). \tag{5}$$

In equation (5), the system is assumed to be under damped so that $0 \leqq \zeta_0 < 1$, and u(t) is the unit step function defined as $$u(t) = \begin{cases} 1, \text{ if } t > 0; \\ 0, \text{ otherwise.} \end{cases} \tag{6}$$

The damped sinusoidal behavior evident in result (5) forms a building block for the development to follow.

Kalman filter theory allows for an arbitrary number of state variables which describe the dynamical system, and an arbitrary number of data sensor inputs which typically drive the system. Thus, it is natural to use a vector to represent the state and a matrix to define the time evolution of the state vector. Most of what follows is in a discrete time frame. Then, the usual notation $$x(n) \equiv x(t) \mid t = t_n,$$

is used, where $t_n < t_m$ when $n < m$ is the discretization of the time axis.

In well logging applications, it is convenient to define all motion relative to a mean logging speed $v_0$. Typically $v_0$ ranges between 0.1 and 1 m/s depending on the logging tool characteristics. The actual cable length z(t) as measured from a surface coordinate system origin, with the "into the earth" direction positive convention, is given by:

$$z(t) = z_0 - v_0(t - t_0) - q(t). \tag{7}$$

where $z_0$ is the cable depth at the beginning of the log at time $t = t_0$, and q(t) is the perturbation of the position around the nominal cable length. The task is to find an unbiased estimator $\hat{q}(t)$ of q(t).

A state space description of equation (1), is in slightly different notation:

$$\dot{x}(t) = Sx(t), \tag{8}$$

where $$x(t) = (q(t), v(t), a_{ex}(t))^T, \tag{9}$$

and where S is the 3×3 matrix $$S = \begin{pmatrix} 0 & 1 & 0 \\ \alpha & \beta & 1 \\ 0 & 0 & 0 \end{pmatrix}. \tag{10}$$

In equation (9), v(t) is the time derivative of q(t), and $a_{ex}(t)$ is the external acceleration. The superscript T stands for transpose, and the parameters $\alpha$ and $\beta$ are given by $$\alpha = -\omega_0^2, \tag{11}$$

and $$\beta = -2\zeta_0\omega_0.$$

Equation (8) defines the continuous time evolution of the state vector x(t). The choice of state vector components q(t) and v(t) in equation (9) are natural since q(t) is the quantity that is required to be accurately determined and v(t) is needed to make matrix equation (8) equivalent to a second order differential equation for q(t). The choice is unusual in the sense that the third component of the state vector $a_{ex}(t)$ is an input and does not couple to the first two components of x(t). However, as will be seen, this choice generates a useful state covariance matrix, and allows the matrix relation between state and data to distinguish the acceleration terms of the model and external forces.

For computation, the discrete analogue of equation (8) is required. For stationary S matrices, Gelb [4] has given a general discretization method based on infinitesimal displacements. Let $T_n = t_{n+1} - t_n$, then expand $x(t_{n+1})$ around $t_n$ in a Tailor series to obtain $$\begin{aligned} x(n+1) &= x(n) + \dot{x}(n)T_n + \ddot{x}(n)T_n^2/2 +, \\ &= (I + ST_n + S^2T_n^2/2 +)x(n), \\ &= F(n)x(n), \end{aligned} \tag{12}$$

where $$F(n) = e^{ST_n}. \tag{13}$$

In equation (12), I is the unit 3×3 matrix. The exponential matrix function F(n) is defined by its power series expansion. The explicit matrix to order $T_n^2$ is $$F(n) = \tag{14}$$

$$\begin{pmatrix} 1 + \alpha T_n^2/2 & (1 + \beta T_n/2)T_n & T_n^2/2 \\ 1 + \beta T_n/2\alpha T_n & 1 + \beta T_n + (\alpha + \beta^2)T_n^2/2 & (1 + \beta T_n/2)T_n \\ 0 & 0 & 1 \end{pmatrix}.$$

Thus, to order $T_n^2$, the dynamics are captured by the discrete state equation $$x(n+1) = F(n)x(n). \tag{15}$$

If initial conditions are supplied on the state x(0), and the third component of x(n), $a_{ex}(n)$ is known for all n, equation (15) recursively defines the time evolution of the dynamical system.

II. Kalman Filter 40a5

A succinct account is given of the Kalman filter derivation. The goal is to estimate the logging depth q(t) and the logging speed v(t) as defined by equations (7) and (8). Complete accounts of the theory are given by Maybeck [5], and Gelb [4].

The idea is to obtain a time domain, non-stationary, optimal filter which uses several (two or more) independent data sets to estimate a vector function x(t). The theory allows for noise in both the data measurement, and the dynamical model describing the evolution of x(t). The filter is optimal for linear systems contaminated by white noise in the sense that it is unbiased and has minimum variance. The estimation error depends upon initial conditions. If they are imprecisely known, the filter has prediction errors which die out over the characteristic time of the filter response.

The theory, as is usually presented, has two essential ingredients. One defines the dynamical properties of the state vector x(n) according to $$x(n+1)=F(n)x(n)+w(n), \tag{16}$$

where $$x(n)=(x_1(n),x_2(n),x_3(n),,x_M(n))^T, \tag{17}$$

is the M dimensional state vector at the time $t=t_n$, ($t_p>t_q$ for $p>q$), F(n) is the M×M propagation matrix, and w(n) is the process noise vector which is assumed to be zero mean and white. The other ingredient is the measurement equation. The N dimensional measurement vector z(n) is assumed to be linearly related to the M dimensional state vector x(n). Thus $$z(n)=H(n)x(n)+v(n), \tag{18}$$

where $$z(n)=(z_1(n),z_2(n),z_3(n),,z_N(n))^T.$$

In equation (18), H is the N×M measurement matrix. The measurement noise vector v(n) is assumed to be a white Gaussian zero mean process, and uncorrelated with the process noise vector w(n). With these assumptions on the statistics of v(n), the probability distribution function of v(n) can be given explicitly in terms of the N×N correlation matrix R defined as the expectation, denoted by $\epsilon$, of all possible cross products $v_i(n)v_j(n)$, viz:

$$R=\epsilon(vv^T), \tag{19}$$

In terms of R, the probability distribution functions is $$p(v) = \frac{1}{(2\pi)^{N/2}|R|^{\frac{1}{2}}} \exp(-v^TR^{-1}v/2). \tag{20}$$

A Kalman filter is recursive. Hence, the filter is completely defined when a general time step from the $n^{th}$ to $(n+1)^{th}$ node is defined. In addition, the filter is designed to run in real time and thus process current measurement data at each time step. A time step has two components. The first consists of propagation between measurements as given by equation (16). The second component is an update across the measurement. The update process can be discontinuous, giving the filter output a sawtooth appearance if the model is not tracking the data properly. As is conventional, a circumflex is used to denote an estimate produced by the filter, and a tilde accompanies estimate errors viz:

$$x(n)=\hat{x}(n)+\tilde{x}(n). \tag{21}$$

In addition, the update across a time node requires a − or + superscript; the (minus/plus) refers to time to the (left/right) of $t_n$ (before/after) the $n^{th}$ measurement has been utilized.

The Kalman filter assumes that the updated state estimate $\hat{x}(n)^+$ is a linear combination of the state $\hat{x}(n)^-$ (which has been propagated from the $(n-1)^{th}$ state), and the measurement vector z(n). Thus $$\hat{x}(n)^+=K'(n)\hat{x}(n)^-+K(n)z(n). \tag{22}$$

The filter matrices K'(n) and K(n) are now determined. As a first step, the estimate $\hat{x}(n)^+$ is required to be unbiased. From equation (21), the estimate $\hat{x}(n)^+$ is unbiased provided that $$\epsilon(\tilde{x}(n)^+)=0. \tag{23}$$

From equations (18), (21), and (22), it follows that $$\tilde{x}(n)^+=(I-K(n)H(n))x(n)-K'(n)\tilde{x}(n)^- -K(n)v(n). \tag{24}$$

By hypothesis, the expectation value of the measurement noise vector v is zero. Hence, from equation (24), the estimate $\hat{x}(n)^+$ is unbiased if and only if $$K'(n)=I-K(n)H(n). \tag{25}$$

Substitution of equation (25) into (22) yields $$\hat{x}(n)^+=x(n)^-+K(n)(z(n)-H(n)\hat{x}(n)^-). \tag{26}$$

In equation (26), the N×M matrix K(n) is known as the Kalman gain. The term $H(n)\hat{x}(n)^-$ is the data estimate $\hat{z}(n)$. Thus if the model estimate $\hat{x}(n)^-$ tracks the data z(n), the update defined by equation (26) is not required. In general, the update is seen to be a linear combination of the model propagated state $\hat{x}(n)^-$, and the error residual $\tilde{z}(n)$. The Kalman gain matrix K(n) is determined by minimizing a cost function. Gelb [4] shows that for any positive semi-definite weight matrix $S_{ij}$, the minimization of the cost function $$C(S) = \epsilon\left(\sum_{i,j=1}^{M} \tilde{x}_i^+ S_{ij}\tilde{x}_j^+\right), \tag{27}$$

with respect to the estimation components $\hat{x}_j^+$, is independent of the weight matrix S. Hence, without loss of generality choose S=I, where I is the M×M unit matrix. Then $$C(I) = T_r(P^+), \tag{28}$$

where $$\begin{aligned} P^+ &= \epsilon(\hat{x}^+(\hat{x}^+)^T), \\ &= \epsilon(\tilde{x}^+(\tilde{x}^+)^T). \end{aligned} \tag{29}$$

In equation (28), Tr is the trace operator. Equation (29) defines the covariance matrix P of the state vector estimate. That it also equals the covariance matrix of the residual vector $\tilde{x}^+$ follows from equations (21) and (23). Result (29) shows all cost functions of the form (27) are minimized when the trace of the state covariance matrix is minimized with respect to the Kalman gain coefficients. A convenient approach to this minimization is through an update equation for the state covariance matrices. To set up this approach, note from equations (18), (21) and (26) that $$\tilde{x}^+ = (I - KH)\tilde{x}^- + Kv. \tag{30}$$

Thus $$P^+ = \epsilon(\hat{x}^+(\hat{x}^+)^T), \tag{31}$$

$$= (I - KH)\epsilon(\tilde{x}^-(\tilde{x}^-)^T)(I - KH)^T + K\epsilon(vv^T)K^T. \tag{32}$$

In going from expression (30) to (31), the state residual and process noise vectors are assumed to be uncorrelated. Using definition (19) of the process noise covariance simplifies expression (30) to $$P^+=(I-KH)P^-(I-KH)^T+KRK^T. \quad (33)$$

Equations (28) and (33) lead to the minimization of the trace of a matrix product of the form $$J=Tr(ABA^T), \quad (34)$$

where B is a symmetric matrix. The following lemma applies:

$$\frac{\partial J}{\partial A_{ij}} = (AB)_{ij}. \quad (35)$$

Application of lemma (35) to minimization of the cost function (28) leads to a matrix equation for the Kalman gain matrix. The solution is $$K=P^-H^T(HP^-H^T+R)^{-1}. \quad (36)$$

Equation (36) defines the optimal gain K. Substitution of equation (36) in the covariance update equation (33) reduces to the simple expression $$P^+=(I-KH)P^-. \quad (37)$$

The derivation is almost complete. It remains to determine the prescription for propagation of the state covariance matrices between time nodes. Thus, the time index n will be re-introduced. By defining relation (16) it follows that $$P(n+1) = \epsilon(\hat{x}(n+1), \hat{x}(n+1)^T), \quad (39)$$
$$= F(n)P(n)F(n)^T + Q(n), \quad (40)$$

where $$Q(n) = \epsilon(w(n)w(n)^T), \quad (40)$$

is the process noise covariance function. Result (40) is based upon the assumption that the state estimate $\hat{x}(n)$ and the process noise w(n) are uncorrelated. This completes the derivation. A summary follows.

There are five equations which define the Kalman filter: two propagation equations, two update equations, and the Kalman gain equation. Thus the two propagation equations are:

$$\hat{x}(n+1)=F(n)\hat{x}(n), \quad (41)$$

$$P(n+1)=F(n)P(n)F(n)^T+Q(n); \quad (42)$$

the two update equations are $$\hat{x}(n)^+=\hat{x}(n)^-+K(n)(z(n)-H(n)\hat{x}(n)^-), \quad (43)$$

$$P(n)^+=(I-K(n)H(n))P(n)^-),$$

and the Kalman gain is $$K(n)=P(n)^-H(n)^T(H(n)P(n)^-+R(n))^{-1}. \quad (44)$$

The time stepping procedure begins at time $t_0$ (n=0). At this time initial conditions on both the state vector and state covariance matrix need be supplied. Thus $$P(0)=P_0, \quad (45)$$

$$\hat{x}(0)=\hat{x}_0. \quad (46)$$

Consider the induction on the integer n beginning at n=1.

$$\hat{x}(1)^-=F(1)\hat{x}_0, \quad (47)$$

$$P(1)^-=F(0)P_0F(0)^T+Q(0),$$

$$K(1)=P(1)^-H(1)^T(H(1)P(1)^-H(1)^T+R(1))^{-1},$$

$$\hat{x}(1)^+=\hat{x}(1)^-+K(1)(z(1)-H(1)\hat{x}(1)^-).$$

The process is seen to be completely defined by recursion given knowledge of the noise covariance matrices Q(n), and R(n). Here, it is assumed that the noise vectors v(n) and w(n) are wide sense stationary [5]. Then the covariance matrices Q and R are stationary (i.e. independent of n). In the depth shift application, the dynamics matrix F(n) is defined by equation (14). The measurement matrix H(n), introduced in equation (18), is 2×3, and has the specific form:

$$H(n) = \begin{pmatrix} 1 & 0 & 0 \\ \alpha & \beta & 1 \end{pmatrix}, \quad (48)$$

where $\alpha$ and $\beta$ are defined by relations (11). In the next section, a method is given to estimate the parameters $\alpha$ and $\beta$ from the accelerometer data.

III. Parameter Estimation

It is necessary that the resonant frequency and damping constant parameters in the Kalman filter be estimated recursively. This is a requirement in the logging industry since sensor data must be put on depth as it is recorded to avoid large blocks of buffered data. Autoregressive spectral estimation methods are ideally suited to this task. (S. L. Marple, Digital Spectral Analysis, Prentice Hall, 1987 chapter 9). Autoregressive means that the time domain signal is estimated from an all pole model. The important feature in this application is that the coefficients of the all pole model are updated every time new accelerometer data is acquired. The update requires a modest 2N multiply computations, where N is on the order of 20. In this method, the acceleration estimate $\hat{x}_{n+1}$ at the $(n+1)^{th}$ time sample is estimated from the previous N acceleration samples according to the prescription $$\hat{x}_{n+1} = -\sum_{k=1}^{N} a_k x_{n+1-k}. \quad (1)$$

The coefficients $a_k$ of the model are updated recursively at each time step, using a term proportional to the gradient with respect to the coefficients $a_k$ of $d_{n+1}$, where $d_{n+1}$ is the expected value of the square of the difference between the measured and estimated acceleration, i.e. $d_{n+1}=\epsilon(|x_{n+1}-\hat{x}_{n+1}|^2)$. In the expression for $d_{n+1}$, $\epsilon$ is the statistical expectation operator. The method has converged when $d_{n+1}=0$.

The resonance parameters for the Kalman filter are then obtained from the complex roots of the polynomial with coefficients $a_k$. FIG. 6 shows an example from actual borehole accelerometer data of the results of this type of spectral estimation. The dominant resonant frequency corresponds to the persistent peak with maximum amplitude at about 0.5 Hz. The damping constant is proportional to the width of the peak. The slow time varying property of the spectrum is evident since the peak position in frequency is almost constant. This means that the more time consuming resonant frequency computation needs be done only once every few hundred cycles of the filter.

FIG. 7 is a flow chart of the parameter estimation algorithm.

IV. Low Pass Filter 40a and High Pass Filter 40a3

Kalman filter theory is based upon the assumption that the input data is Gaussian. Since the accelerometer can not detect uniform motion, the Gaussian input assumption can be satisfied for the depth wheel data if the uniform motion component of the depth wheel data is removed before this data enters the Kalman filter. As shown in the FIG. 6, the depth wheel data is first passed through a complementary pair of low and high-pass digital filters. The high-pass component is then routed directly to the Kalman filter while the low-pass component, corresponding to uniform motion, is added to the output of the Kalman filter. In this manner, the Kalman filter estimates deviations from depth wheel, so that if the motion of the tool string is uniform, the Kalman output is zero.

For there to be no need to store past data, a recursive exponential low-pass digital filter is chosen for this task. In order to exhibit quasi-stationary statistics, differences of the depth wheel data are taken. Let $z_n$ be the depth wheel data at time $t_n$. Then define the $n^{th}$ depth increment to be $dz_n = z_n - z_{n-1}$. A low-pass increment $dz_n$ is defined as $$\check{dz}_n = g\, dz_n + (1-g)\check{dz}_{n-1}. \quad (1)$$

In Eq. 1, g is the exponential filter gain, $(0<g<1)$. The low-pass depth data is thus $$\check{z}_n = \check{z}_{n-1} + \check{dz}_n, \quad (2)$$

while the corresponding high-pass depth is $$\bar{z}_n = z_n - \check{z}_n. \quad (3)$$

For a typical choice of gain $g=0.01$, the time domain filter of Eq. 1 has a low-pass break point at 6.7 Hz for a logging speed of 2000 ft/hr when a sampling stride of 0.1 in is used.

V. Mean-Removing or Moving Average Filter 40a2

The simple moving average mean-removing filter 40a2 is implemented recursively for the real time application. Let the digital input signal at time $t=t_n$ be x(n). The function of the demeaning filter is to remove the average value of the signal. Thus, let y(n) be the mean-removed component of the input signal x(n), where $x(n)=a_z(t)$ and $y(n)=d(t)$, as referenced hereinabove. Then $$y(n) = x(n) - x_{avg}(n), \quad (1)$$

where the average value is taken over N previous samples, i.e., $$x_{avg}(n) = \frac{1}{N}\sum_{m=0}^{N-1} x(n-m). \quad (2)$$

Eqns 1 and 2 can be manipulated into the recursive form $$y(n) = y(n-1) + (1-1/N)x(n) + (1/N)x(n-N) - x(n-1). \quad (3)$$

An efficient implementation of the recursive demeaning filter given by eqn 3 uses a circular buffer to store the N previous values of x(n) without shifting their contents. Only the pointer index is modified each cycle of the filter. The first N cycles of the filter require initialization. The idea is to use eqn 1, but to modify eqn 2 for $n<N$ by replacing N by the current cycle number. The resulting initialization sequence for $x_{avg}(n), n<N$ can also be defined recursively. The result is $$x_{avg}(n) = \begin{cases} x(n) & \text{if } n = 1; \\ x_{avg}(n-1) + (1/n)(x(n) - x_{avg}(n)), & \text{if } 1 < n < N. \end{cases} \quad (4)$$

A flow graph of the demeaning filter (also called a moving average filter) is given by FIG. 8.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

I claim:

1. A well logging system including a well logging tool adapted to be suspended from a cable in a borehole said tool including an accelerometer, a first depth determination means for generating an output which provides an indication of the depth of said tool in said borehole, and a second depth determination means for deriving from the output from said first depth determination means a corrected indication of the depth of said tool in said borehole, said second depth determination means comprising:

first means responsive to an output signal from said accelerometer for generating an output signal representative of a resonance behavior of the tool-cable system;

second means responsive to said output signal from said first means for developing a correction factor; and means for combining the correction factor with the output of the first depth determination means thereby providing said corrected indication of depth.

2. The second depth determination means of claim 1, further comprising:

third means responsive to the output signal from said accelerometer for generating an output signal which is a dynamic variable, said dynamic variable representing a component of acceleration along the axis of said borehole due to an unexpected lurch in the tool cable.

3. The second depth determination means of claim 2, wherein said second means develops said correction factor in response to both said output signal from said first means and said output signal from said third means.

4. The second depth determination means of claim 3, further comprising:

fourth means responsive to the indication of depth from said first depth determination means for providing a first output signal $z_2$ representative of an incremental distance in response to said unexpected lurch in said tool cable and for providing a second output signal $z_1$ representative of a constant speed component of the indication of depth from the first depth determination means.

5. The second depth determination means of claim 4, wherein said second means develops said correction factor in response to said output signal from said first means, to said output signal from said third means, and to said first output signal $z_2$ from said fourth means.

6. The second depth determination means of claim 5, wherein the combining means arithmetically applies said correction factor to said second output signal $z_1$ of said fourth means thereby providing said corrected indication of the depth of said tool in said borehole.

7. The second depth determination means of claim 1, wherein said first means generates said output signal representative of a resonant frequency and a damping constant of said tool-cable system in response to said output signal from said accelerometer.

8. A method of correcting a depth reading produced from a depth wheel when a well logging tool, suspended from a cable, is lowered into or drawn from a borehole of an oil well, said well logging tool including an accelerometer means for producing an acceleration output signal indicative of the instantaneous acceleration of said tool along the axis of said borehole, comprising the steps of:

estimating a set of resonance parameters associated with a resonance behavior of the tool-cable system when said tool is disposed at an approximate depth in said borehole in response to said output signal from said accelerometer means indicative of said instantaneous acceleration of said tool;

producing a correction factor in response to said set of resonance parameters; and correcting said depth reading from said depth wheel using said correction factor to perform the correction.

9. The method of claim 8, further comprising the step of:

prior to the producing step, determining a dynamic variable that is a function of said instantaneous acceleration and a function of a component of acceleration due to gravity when said tool is disposed in said borehole, said correction factor being produced in response to said dynamic variable in addition to said set of resonance parameters.

10. The method of claim 9, further comprising the step of:

prior to the producing step, further determining a differential distance figure that is produced when said tool is instantaneously lurched in said borehole, said correction factor being produced in response to said differential distance figure in addition to said dynamic variable and said set of resonance parameters.

11. The method of claim 10, wherein the correcting step further comprises the steps of:

prior to the producing step, determining a constant speed component of said depth reading from said depth wheel and adding said correction factor to said constant speed component thereby correcting the depth reading and providing a corrected indication of the depth of said tool in said borehole.

12. The method of claim 8, wherein the estimating step comprises the steps of:

estimating a resonance frequency associated with a vibration of said cable of said tool when said tool is disposed at said approximate depth; and estimating a damping constant associated with a vibration of said cable of said tool when said tool is disposed at said approximate depth.

* * * * *